US005699257A

United States Patent [19]

Emmett et al.

[11] Patent Number: 5,699,257

[45] Date of Patent: Dec. 16, 1997

[54] POSTAGE METER

[75] Inventors: James S. Emmett, Derby; John J. Hobral, Beacon Falls, both of Conn.

[73] Assignee: Micro General Corporation, Santa Ana, Calif.

[21] Appl. No.: 641,633

[22] Filed: May 2, 1996

[51] Int. Cl.[6] ..... B41J 9/00; B41J 9/14; G07B 17/00

[52] U.S. Cl. ..... 364/464.18; 400/159

[58] Field of Search ..... 347/103; 364/464.02, 364/464.03, 464.18; 400/159

[56] References Cited

U.S. PATENT DOCUMENTS

| | | | |
|---|---|---|---|
| 3,209,681 | 10/1965 | Sanborn | 101/93 |
| 3,769,906 | 11/1973 | Martin | 101/91 |
| 3,869,986 | 3/1975 | Hubbard | 101/91 |
| 4,036,128 | 7/1977 | Easton | 101/9 |
| 4,218,971 | 8/1980 | Uhl et al. | 101/35 |
| 4,326,814 | 4/1982 | Schaffer et al. | 400/125.1 |
| 4,376,981 | 3/1983 | Check, Jr. et al. | 364/570 |
| 4,393,386 | 7/1983 | Di Giulio | 346/75 |
| 4,410,901 | 10/1983 | Szeliga et al. | 346/165 |
| 4,473,008 | 9/1984 | Heyman | 101/170 |
| 4,492,159 | 1/1985 | Clark | 101/71 |
| 4,492,160 | 1/1985 | Clark et al. | 101/71 |
| 4,493,252 | 1/1985 | Clark | 101/71 |
| 4,530,286 | 7/1985 | Samuels | 101/395 |
| 4,573,174 | 2/1986 | Crowley et al. | 377/39 |
| 4,580,144 | 4/1986 | Calvi | 346/76 PH |
| 4,641,346 | 2/1987 | Clark et al. | 380/3 |
| 4,660,221 | 4/1987 | Dlugos | 380/23 |
| 4,682,541 | 7/1987 | Pollack, Jr. et al. | 101/91 |
| 4,709,632 | 12/1987 | Samuels et al. | 101/163 |
| 4,835,713 | 5/1989 | Pastor | 364/519 |
| 4,900,903 | 2/1990 | Wright et al. | 235/380 |
| 4,900,904 | 2/1990 | Wright et al. | 235/381 |
| 4,917,010 | 4/1990 | Gilham et al. | 101/93.04 |
| 4,949,381 | 8/1990 | Pastor | 380/51 |
| 5,075,862 | 12/1991 | Doeberl et al. | 390/117 |
| 5,200,903 | 4/1993 | Gilham | 364/464.18 |
| 5,239,168 | 8/1993 | Durst, Jr. et al. | 235/432 |
| 5,326,181 | 7/1994 | Eisner et al. | 400/104 |
| 5,415,479 | 5/1995 | Kuhn et al. | 400/104 |
| 5,602,742 | 2/1997 | Solondz et al. | 364/464.2 |

*Primary Examiner*—Edward R. Cosimano

*Attorney, Agent, or Firm*—Fitzpatrick, Cella, Harper & Scinto

[57] ABSTRACT

A postage meter prints postage indicia onto envelopes using extendible segments. The postage meter includes a user interface for entering input information, a transfer means having extendible segments disposed thereon, the segments being arranged to form the postage indicia when extended, and an ink roller, which contacts extended ones of the segments so as to transfer ink from the ink roller to the extended ones of the segments. Also included in the postage meter are a sensor, which senses an envelope in the postage meter, and which outputs a signal which indicates that an envelope is present in the postage meter, and a controller. The controller (1) converts the input information into the postage indicia, (2) extends ones of the segments based on the postage indicia, and (3) activates the transfer means in response to the signal output by the sensor so that (i) extended segments receive ink by contacting the ink roller, and (ii) the extended segments transfer the ink received from the ink roller to the envelope.

24 Claims, 10 Drawing Sheets

POSTAGE METER

BACKGROUND OF THE INVENTION

Field of the Invention

The present invention relates to a postage meter having a transfer means which includes an engraved die, a datewheel assembly and extendible segments, which is used for printing fixed and variable postage indicia on envelopes.

DESCRIPTION OF THE RELATED ART

Postage meters which print postage indicia on envelopes are well known in the art. Such postage meters, however, rely on complex mechanical arrangements to print variable postage indicia, such as postage amount, which may change with each indicium. For example, one type of conventional postage meter uses printwheels disposed within a transfer drum which are rotated into position using racks located near an axis of the transfer drum in order to print the postage indicia. Arrangements such as this typically require a large number of small moving parts. As a result, conventional postage meters are prone to malfunctions, not to mention costly to manufacture and to maintain. For example, the moving parts used in conventional postage meters may require periodic cleaning in order to ensure optimum functionality, which, depending upon the amount of work involved, can be costly.

Moreover, because conventional postage meters rely on complex mechanical arrangements to print postage indicia, conventional postage meters are limited as to the amount of variable postage indicia that they can print, and are unsuited to printing PostNet-style barcodes, for example, simultaneously with other postage indicia.

Thus, there exists a need for a postage meter which does not rely on a complex mechanical arrangement to print variable postage indicia.

SUMMARY OF THE INVENTION

The present invention addresses the foregoing need by providing a postage meter having a controller which controls extension of segments on a transfer means in order to form variable postage indicia, such as postage amount, on the transfer means. By controlling extension of the segments using a controller, such as a microprocessor, rather than a complex mechanical arrangement, the present invention is able to reduce malfunctions in the postage meter caused by mechanical problems. In addition, because the present invention does not rely on a complex mechanical arrangement, additional segments, for printing additional information, can be included on the transfer means without significantly increasing the size of the postage meter.

Thus, according to one aspect, the present invention is a postage meter which prints postage indicia comprised of postage amount, barcode information, fixed postage information, and a datestamp, onto envelopes. The postage meter uses extendible segments to print the postage amount and barcode information, an engraved die to print the fixed postage information and a datewheel assembly to print the datestamp. The postage meter includes a user interface for entering input information, and a sensor, which senses an envelope in the postage meter, and which outputs a signal which indicates that an envelope is present in the postage meter. Also included in the postage meter are a transfer means having disposed thereon, (1) the extendible segments, the extendible segments being arranged to form the postage amount and the barcode information when extended, (2) the engraved die, and (3) the datewheel assembly. An ink roller contacts extended ones of the segments, the engraved die and the datewheel assembly, so as to transfer ink from the ink roller to the extended ones of the segments, the engraved die and the datewheel assembly. A controller (1) converts the input information into the postage amount and the barcode information, (2) extends appropriate ones of segments based on the postage amount and the barcode information, and (3) activates the transfer means in response to the signal output by the sensor so that (i) extended segments, the engraved die and the datewheel assembly receive ink by contacting the ink roller, and (ii) the extended segments, the engraved die and the datewheel assembly transfer the ink received from the ink roller to the envelope.

By virtue of the foregoing arrangement, particularly the extendible segments, it is possible to print variable postage indicia, such as postage amount, without using a complicated mechanical arrangement. Moreover, because the foregoing postage meter prints barcode information in addition to postage amount, fixed information and a datestamp, coded information can also be printed onto envelopes. In preferred embodiments of the foregoing postage meter, the barcode information can be used to verify variable postage indicia, such as postage amount.

According to another aspect, the present invention is a postage meter which prints postage indicia onto envelopes using extendible segments. The postage meter includes a user interface for entering input information, a transfer means having extendible segments disposed thereon, the segments being arranged to form the postage indicia when extended, and an ink roller, which contacts extended ones of the segments so as to transfer ink from the ink roller to the extended ones of the segments. Also included in the postage meter are a sensor, which senses an envelope in the postage meter, and which outputs a signal which indicates that an envelope is present in the postage meter, and a controller. The controller (1) converts the input information into the postage indicia, (2) extends ones of the segments based on the postage indicia, and (3) activates the transfer means in response to the signal output by the sensor so that (i) extended segments receive ink by contacting the ink roller, and (ii) the extended segments transfer the ink received from the ink roller to the envelope.

As noted above, the foregoing aspect of the present invention suffers from fewer malfunctions, and is able to print more postage information, than its conventional counterparts.

In preferred embodiments of the foregoing postage meter, the postage indicia comprises numeric information which represents a postage amount, and barcode information. The barcode information can comprise a barcode equivalent of the numeric information or it can comprise other information, such as a total number of mail pieces printed by the postage meter, which can be used to verify the numeric information electronically.

In still other preferred embodiments of the foregoing postage meter, following printing of the postage indicia on the envelope, all extended segments are retracted to their unextended positions. By virtue of this feature, any attempt at fraudulent use of the postage meter by manually manipulating the transfer means will result in postage indicia in which no postage amount is printed.

In still other preferred embodiments of the foregoing postage meter, the user interface comprises a rate-calculating scale for weighing an envelope, and for generating a postage amount for the envelope based on a weight of the envelope. In such cases, the postage amount generated by the rate-calculating scale comprises the input information. Advantageously, the rate-calculating scale obviates the need to calculate postage amount for a mail piece beforehand.

In other embodiments, a postage amount can be input from a connected computer. These embodiments provide additional flexibility in inputting a postage amount, and are particularly advantageous in cases where the postage meter is connected to a local area network, or the like.

According to still another aspect, the present invention is a method of forming postage indicia onto an envelope using a postage meter which prints postage indicia comprised of postage amount, barcode information, fixed postage information, and a datestamp, onto envelopes. The postage meter uses extendible segments to print the postage amount and barcode information, an engraved die to print the fixed postage information and a datewheel assembly to print the datestamp. The method includes the steps of inputting a postage amount into the postage meter, converting the postage amount into barcode information, and extending appropriate ones of the segments based on the postage amount and the barcode information to form the postage amount and the barcode information, respectively, from extended segments. Also included in the method are the steps of inputting an envelope into the postage meter, and receiving a signal which indicates that the envelope has been input into the postage meter. A transfer means having disposed thereon, (1) the extendible segments, (2) the engraved die, and (3) the datewheel assembly, is activated so that the extended segments, the engraved die and the datewheel assembly receive ink from an ink roller and transfer the ink received from the ink roller onto the envelope input into the postage meter.

The foregoing method makes it possible to print postage indicia comprised of postage amount, barcode information, fixed information and a datestamp, onto envelopes without using a complex mechanical arrangement.

According to still another aspect, the present invention is a method of forming postage indicia on an envelope using a postage meter having a transfer means which forms the postage indicia on the envelope using extended segments. The method includes the steps of inputting information into the postage meter, converting the input information into postage indicia, extending ones of the segments on the transfer means to form the postage indicia, and inputting an envelope into the postage meter. Also included in the method is a step of receiving a signal which indicates that the envelope has been input into the postage meter. In the method, the transfer means is activated so that (1) extended segments contact an ink roller in order to transfer ink from the ink roller onto the extended segments, and (2) the extended segments contact the envelope in order to transfer the ink received from the ink roller to the envelope.

Advantageously, as was the case above, the foregoing method reduces the complexities of printing postage indicia on envelopes, described above, which are associated with conventional postage meters.

In preferred embodiments of the foregoing method, the barcode information comprises 67 bars. The 67 bars are allocated as follows: (1) bars 1 and 67 comprise long bars, (2) bars 2 to 5 comprise bars used to identify a type of barcoding used by the postage meter, (3) bars 6 to 31 comprise bars used to identify a serial number of the postage meter, (4) bars 32 to 61 comprise bars used to represent an item count comprising a total number of mail pieces printed by the postage meter, and (5) bars 62 to 66 comprise a PostNet check digit. In such embodiments, preferably, the barcode information is used to verify the postage amount by scanning-in the barcode information, and comparing the item count to one of either (1) an item count from a previous day or (2) plural predetermined item counts and a predetermined value. In these embodiments, the postage amount is considered valid if the item count is both greater than the item count from the previous day and different from the plural predetermined item counts and less than the predetermined value. On the other hand, the postage amount is considered invalid if the item count is either less than the item count from the previous day or the same as one of the plural predetermined item counts or greater than the predetermined value. This feature of the present invention makes it possible to detect forged postage indicia.

This brief summary has been provided so that the nature of the invention may be understood quickly. A more complete understanding of the invention can be obtained by reference to the following detailed description of the preferred embodiments thereof in connection with the attached drawings.

DETAILED DESCRIPTION OF THE PREFERRED EMBODIMENTS

In brief, the present invention is a postage meter which prints postage indicia onto envelopes using extendible segments. The postage meter includes a user interface for entering input information, a transfer means having extendible segments disposed thereon, the segments being arranged to form the postage indicia when extended, and an ink roller, which contacts extended ones of the segments so as to transfer ink from the ink roller to the extended ones of the segments. Also included in the postage meter are a sensor, which senses an envelope in the postage meter, and which outputs a signal which indicates that an envelope is present in the postage meter, and a controller. The controller (1) converts the input information into the postage indicia, (2) extends ones of the segments based on the postage indicia, and (3) activates the transfer means in response to the signal output by the sensor so that (i) extended segments receive ink by contacting the ink roller, and (ii) the extended segments transfer the ink received from the ink roller to the envelope.

Figure 1:
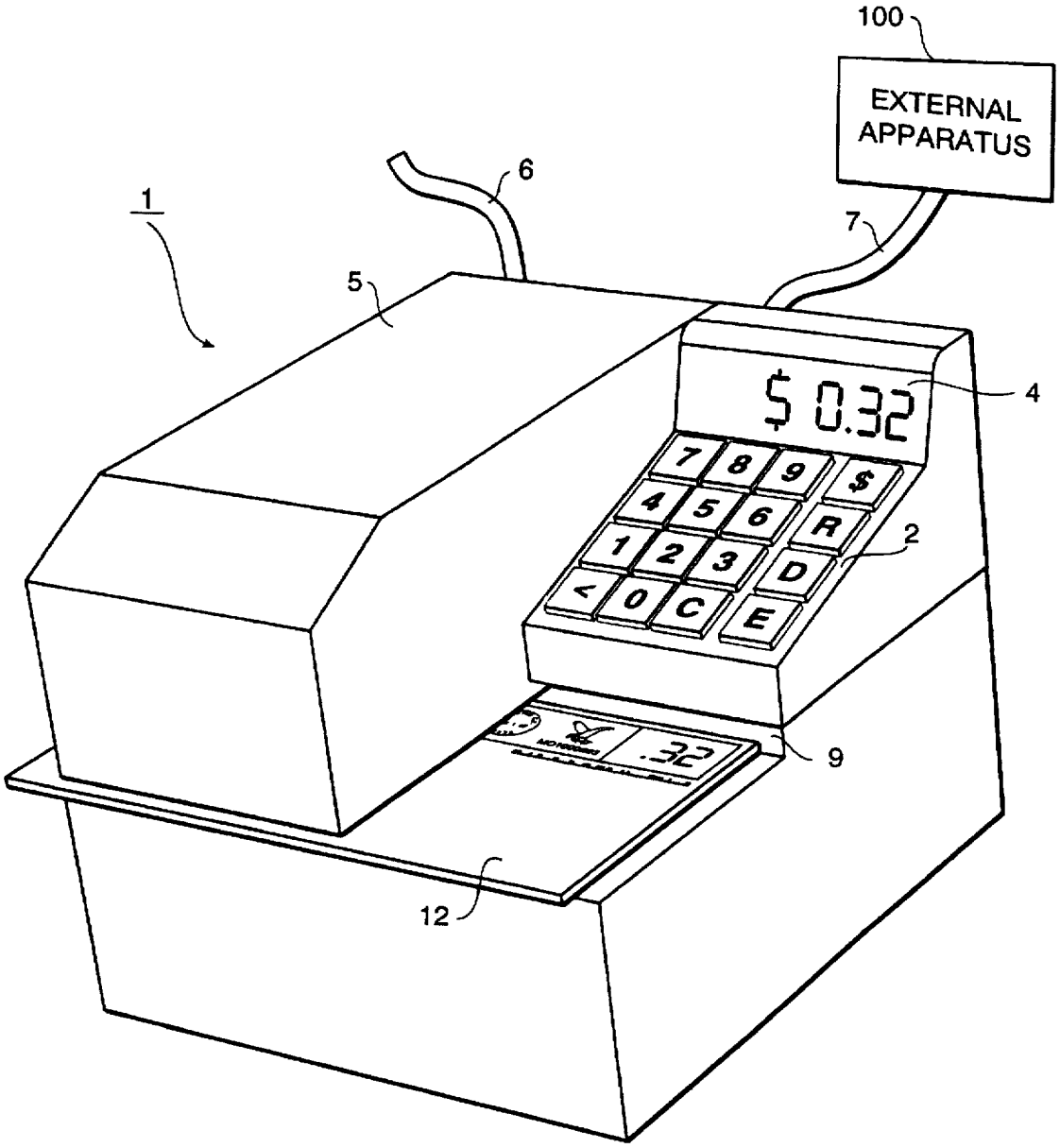
FIG. 1 shows an outward appearance of a postage meter according the present invention.

The outward appearance of a representative embodiment of the foregoing postage meter is shown in FIG. 1. As shown, postage meter 1 includes user interface 2, having keypad 3 and display 4.

Display 4 can be a liquid crystal display, or the like. Variable postage information, such as postage amount, mailing method (e.g., first class, second class, airmail), etc. is input via keypad 3. Display 4 displays the postage information input via keypad 3. If this information is incorrect, a user can edit the information as desired.

User interface 2 can also include rate-calculating scale 5, also shown in FIG. 1. Rate-calculating scale 5 is used to weigh mail pieces, such as envelopes and the like. This weight is used to determine a postage amount for a particular mail piece, as is described in more detail below. Once the postage amount is determined, as was the case above, it is displayed on display 4, from which the postage amount can be edited via keypad 3.

Telephone line 7, shown in FIG. 1, connects postage meter 1 to an external apparatus 100, such as a computer, or to plural external apparatuses via a local area network. Through line 7, postage meter 1 can receive postage information, such as postage amount, for a particular mail piece, from a connected computer. Postage information input in this way is also displayed on display 4, and can be edited via keypad 3.

Postage meter 1 includes envelope guide 9 for conveying envelope 12 through postage meter 1 to printing position 10, at which postage indicia displayed on display 4 is printed on the envelope. Thus, upon insertion of an envelope or the like into postage meter 1, an input postage amount, along with other information, is printed on an envelope. This process is described in more detail below.

Postage meter 1 can include a card reader (not shown), which can read a magnetic strip on a back of a debit card, credit card, or the like. By reading a back of one of these cards, transferring the card information to a remote location, and crediting an amount transferred, postage meter 1 can recharge itself. Postage meter 1 can also request and receive additional recharging postage through telephone line 7 via an internal modem (not shown).

Power is supplied to postage meter 1 via electrical connection 6. In preferred embodiments, postage meter 1 receives power from a conventional 110/120 volt AC outlet.

Figure 2:
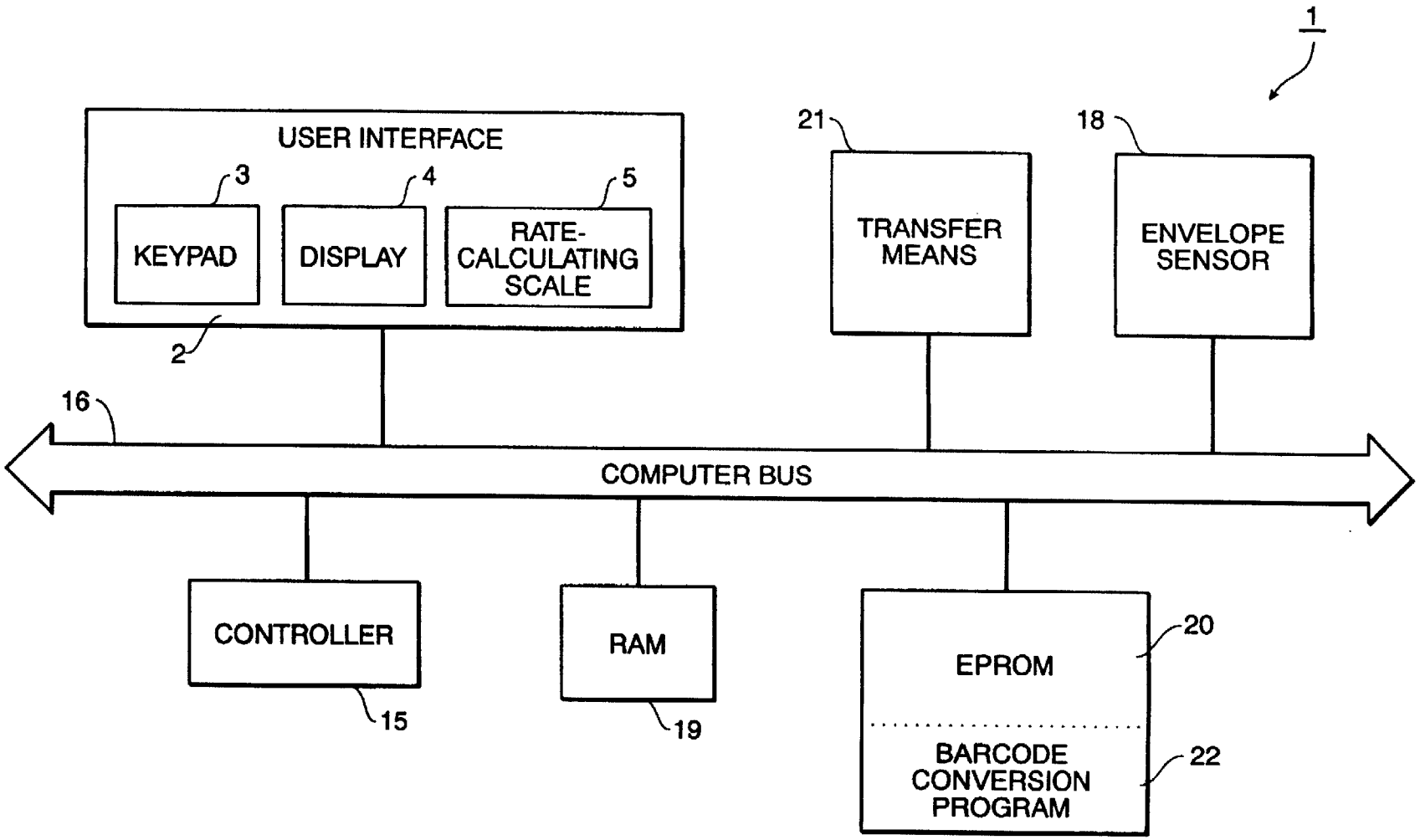
FIG. 2 shows the internal structure of the postage meter of FIG. 1.

FIG. 2 is a detailed block diagram showing the internal construction of postage meter 1. As shown in FIG. 2, postage meter 1 includes controller 15 interfaced to computer bus 16. Also interfaced to computer bus 16 are user interface 2—including keypad 3, display 4 and rate-calculating scale 5—, envelope sensor 18, RAM 19, EPROM 20, and transfer means 21.

Controller 15 controls interaction between the foregoing components of postage meter 1. Controller 15 can comprise any type of commercially-available microprocessor. Specific functions of controller 15 are described in greater detail below.

EPROM 20 provides read-only memory storage for storing programs executable by controller 15, such as barcode conversion program 22. Barcode conversion program 22 converts input postage information into barcode information. As defined herein, this barcode information comprises part of the postage indicia printed by postage meter 1.

The barcode information generated by barcode conversion program 22 can comprise a barcode version of the variable postage information (e.g., postage amount) printed on the envelope. Thus, the U.S. Post Office, which electronically scans barcode information in order to verify postage information printed on the envelope, can use the barcode information printed by the present invention to verify the variable postage indicia.

It is noted, however, that the barcode information printed by postage meter 1 is not limited to the foregoing, or to barcode representations of zip codes and the like as is conventional barcode information. Rather, the barcode information can comprise any information that a user wishes to print on an envelope.

In this regard, in preferred embodiments of postage meter 1, barcode conversion program 22 provides 67 bars of barcode information. The barcode information generated by barcode conversion program 22 is 5 bars (or one digit) longer than the longest valid U.S. Postal Service PostNet barcode. This length discrepancy advises a barcode reading apparatus that the barcode information does not represent a standard PostNet barcode, but rather represents the barcoding described herein.

The foregoing 67 bars of barcode information, as is the case with conventional PostNet barcodes, are either short, e.g., 0.050 inches, to represent "0", or long, e.g., 0.125 inches, to represent "1". This features permits the barcoding provided by the present invention to be interpreted by a conventional apparatus used to read standard PostNet barcodes, without major modifications being made to such an apparatus.

To permit the barcodes of the present invention to be read by conventional barcode reading apparatuses, certain conventions must be followed in the present barcoding system. These conventions are set forth in the U.S. Post Office's Domestic Mail Manual (hereinafter "DMM"), and are noted below, where applicable.

To summarize, the present invention provides a barcoding system in which 67 individual bars are allocated as follows:

Bars 1 and 67 are long bars, as required by the DMM.

Bars 2 to 5 are coded to provide a binary value of "0001", in order to identify the type of coding as that described herein. Binary values of "0010" to "1111" are allocated for use by the U.S. Post Office to identify other types of coding.

Bars 6 to 31 provide a binary code which represents the serial number of the postage meter used to print the barcode. Here, the usable range of serial numbers is from 0 to 67,108,863. In preferred embodiments of the invention, letters in the serial number are not coded.

Bars 32 to 61 provide a binary code which represents an encrypted number in the range of 0 to $2^{25}$. This number comprises the item count, which is the total number of mail pieces ever printed by the postage meter. In the present invention, each postage meter is assigned an encryption keyset which consists of a private key that is programmed into the postage meter, and a public key, that is available to the U.S. Post Office. Each time the postage meter prints postage indicia, the item count is encrypted (e.g., incremented) via an algorithm, such as DES or RSA, using the private key. The public key is described below.

Bars 62 to 66 represent a normal PostNet check digit. If previous bars have been read in groups of five (representing decimal digits), the check digit comprises a number which is added to a sum of the previous decimal digits so that a final sum is a multiple of 10.

As noted above, the foregoing barcode information can be read and verified by a modified conventional barcode reading apparatus. In such an apparatus, verification of the barcode information is performed in order to prevent counterfeit or forged barcode information from being used. The reading and verification processes are described below.

In a barcode reading apparatus, barcode information on an envelope is scanned-in. The barcode information is recognized as being of the foregoing type based on the total number of bars in the barcode information and based on bars 2 to 5 and 62 to 66, as described above.

The reading apparatus retrieves the postage meter's public key from a memory. The reading apparatus then reads the encrypted item count from bars 32 to 61. The item count is decrypted with the retrieved public key in order to determine the actual item count depicted by bars 32 to 61.

Figure 11:
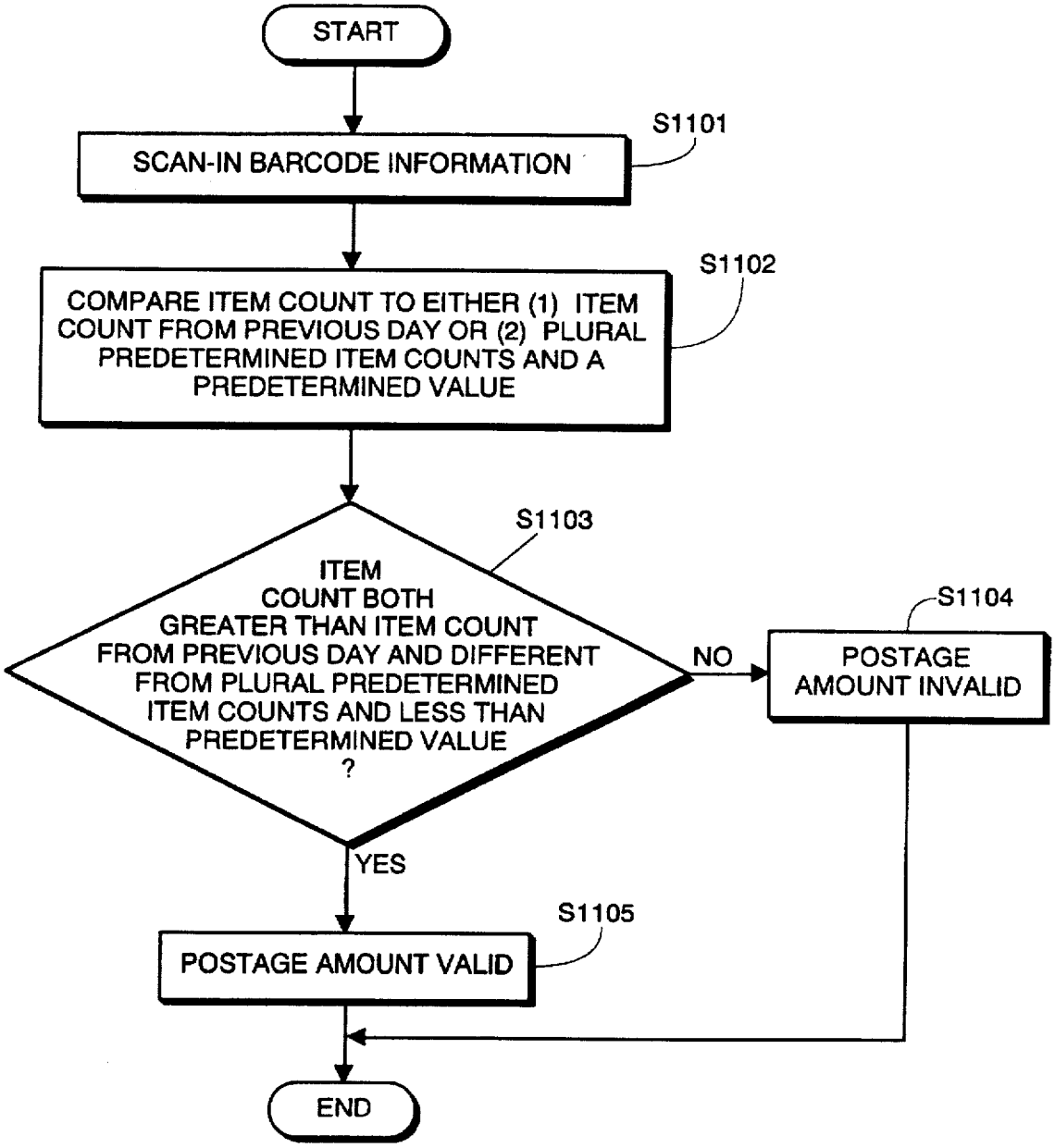
FIG. 11 is a flow diagram showing process steps for determining whether a postage amount is valid.

As shown in steps S1101 to S1105 of FIG. 11, following decryption, the item count is verified by the reading apparatus. More specifically, the item count is compared to the highest item count determined for the postage meter on any previous day. If the item count is higher than that of a previous day, the reading apparatus then determines (1) whether the item count is different from all item counts scanned for the postage meter on that day, and (2) whether the item count is less than ten million (10,000,000). If each of these conditions is met, the item count is considered verified. In this manner, the barcode reading apparatus is able to determine that the postage indicia, and thus the postage amount, is authentic.

As noted above, although preferred embodiments of the present invention use the foregoing coding method, barcode conversion program can also comprise a program to convert the input postage information into standard PostNet barcodes, which provide only zip code information. In this regard, barcode conversion program 22 can comprise a program that converts the input postage information into any type of barcode or machine-readable format, such as a two-dimensional barcodes, optically-readable characters, magnetically-readable characters, etc. It is noted, however, that an additional printing device would be required for any barcode not adhering to the PostNet physical format, as set forth in the DMM.

Referring back to FIG. 2, RAM 19 also stores a current amount of postage charged in postage meter 1. That is, as noted above, postage meter 1 can be re-charged with postage paid via a credit card or the like. Controller 15 stores this postage in RAM 19. Once a postage value has been printed on an envelope, controller 15 re-calculates the current amount of postage charged in postage meter 1 by subtracting the printed amount from a current amount of postage stored in RAM 19. Thereafter, controller 15 stores the newly-calculated postage value in RAM 19. RAM 19 can be backed-up with a battery, in order to maintain current postage amounts upon powering-off of postage meter 1.

RAM 19 also provides random-access memory storage for use by controller 15 when executing a program, such as barcode conversion program 22. In addition, RAM 19 can be used as a print buffer to store postage indicia temporarily prior to printing.

User interface 2, which includes keypad 3 display 4, and rate-calculating scale 5, is used to input postage information to postage meter 1 and to display the input postage information to a user. More specifically, as noted above, postage information can be input via keypad 3. When a key on keypad 3 is depressed, a code which is specific to the depressed key is transmitted to controller 15. Controller 15 receives and deciphers the transmitted code to determine what postage information has been input (or, alternatively, what function has been activated). Thereafter, controller 15 uses that information to generate the postage indicia for printing (or to execute the activated function).

As noted above, postage information, such as postage amount, can also be determined via rate-calculating scale 5. In this case, two scenarios are possible. First, rate-calculating scale 5 can determine a postage amount internally, in which case controller 15 merely receives the postage amount from rate-calculating scale 5. Alternatively, rate-calculating scale 5 can merely transfer the weight of a particular mail piece to postage meter 1. Thereafter, controller 15 can determine a proper postage amount for that mail piece based on the received weight.

In a similar manner, as noted above, postage information can be input via an external apparatus, such as a computer, via telephone line 7.

Controller 15 generates image data which corresponds to the input postage information, or alternatively, executes a function which corresponds to a depressed key on keypad 3. In a case where image data is generated, such as when a postage amount is input, controller 15 transfers that image data to display 4 over computer bus 16. Thereafter, display 4, which was described above, displays the information to the user.

Envelope sensor 18 is used to detect a leading edge of an envelope which has been inserted into printing position 10 via envelope guide 9. When an envelope is detected at printing position 10, envelope sensor 18 generates a signal which it outputs to controller 15 over computer bus 16. As described in more detail below, controller 15 activates transfer means 21 to print postage indicia in response to this signal from envelope sensor 18.

Figure 3:
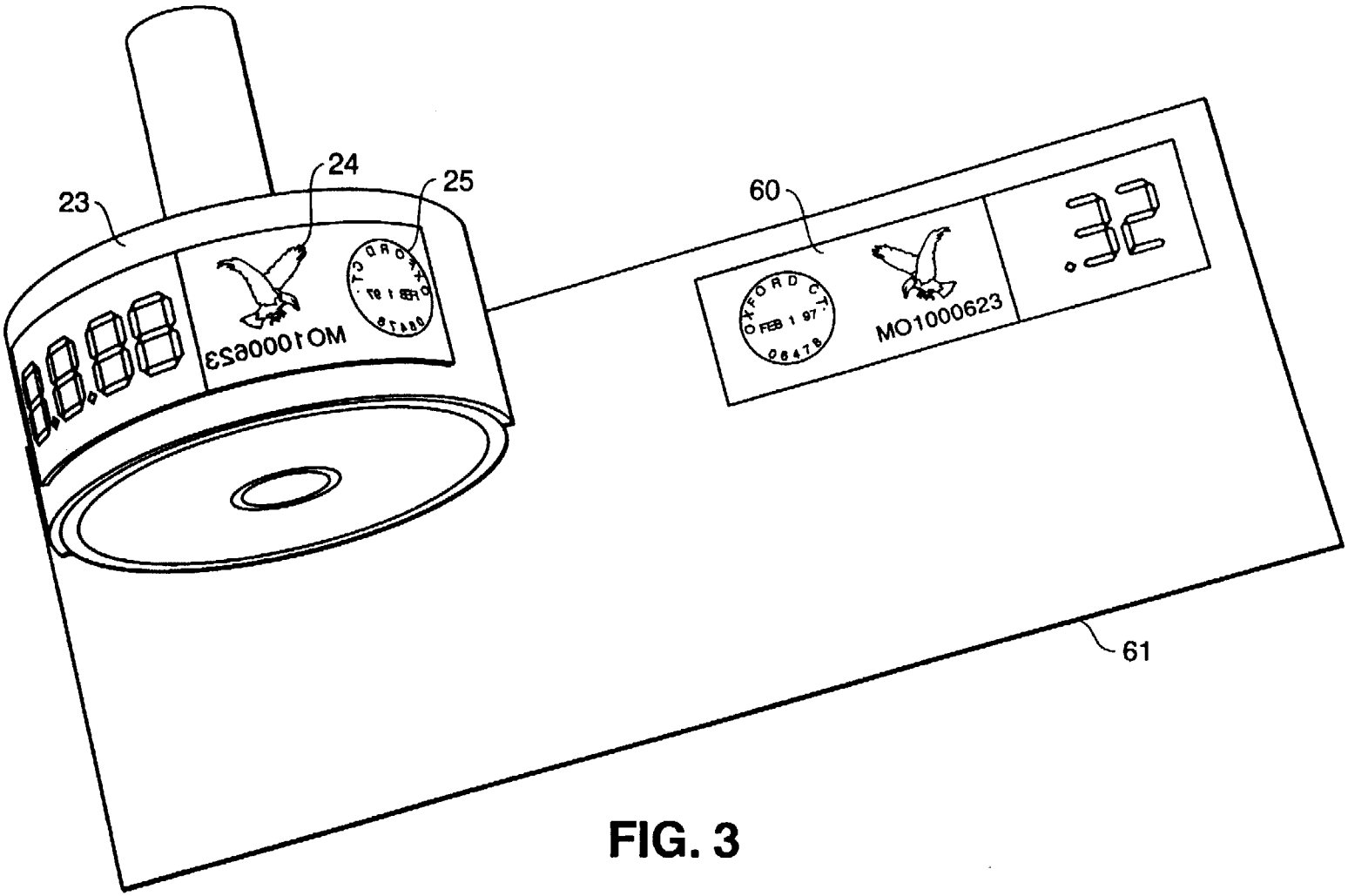
FIG. 3 shows an example of a transfer means which comprises a transfer drum, following printing of postage indicia on an envelope.
Figure 4:
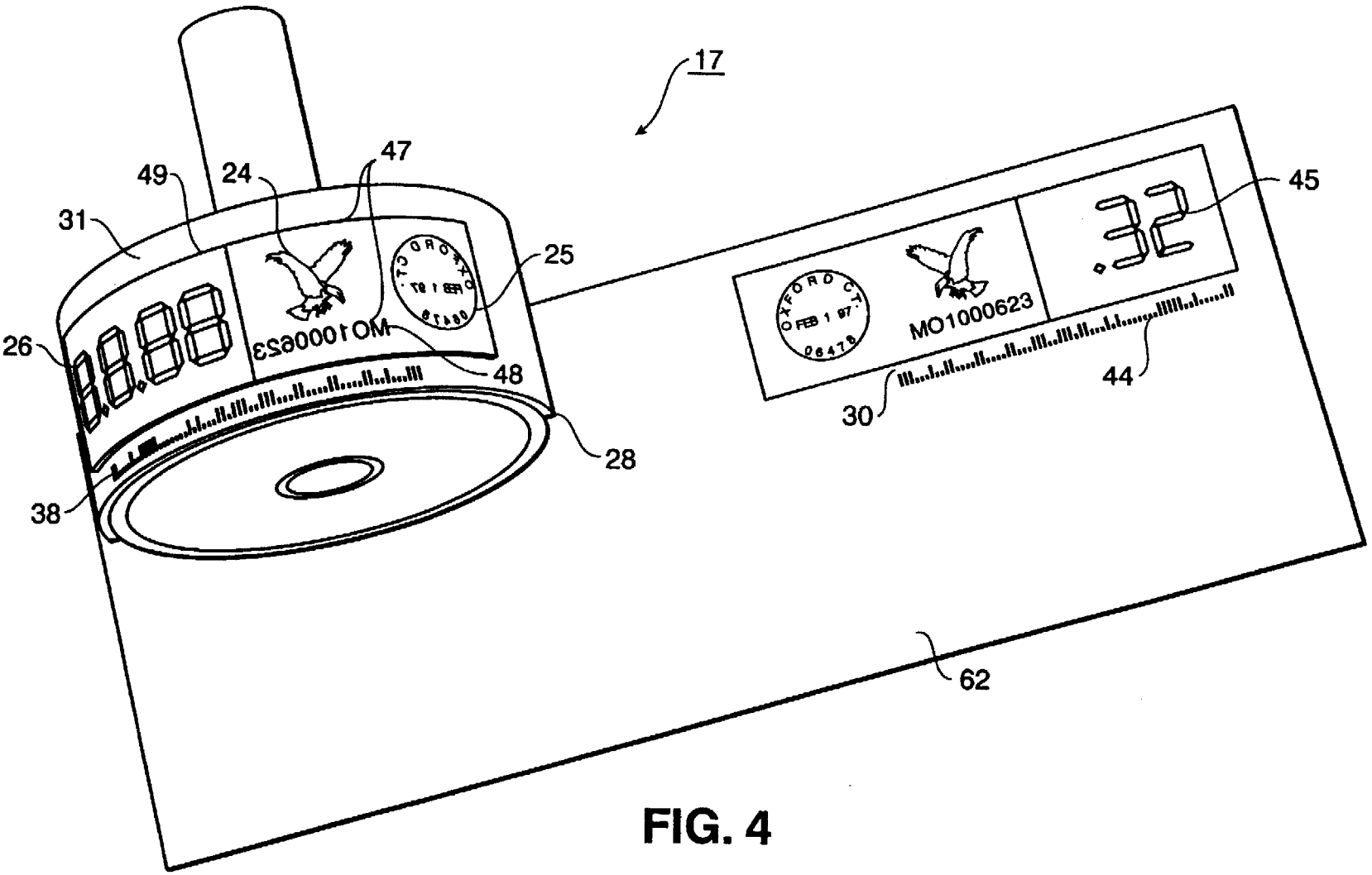
FIG. 4 shows an example of the transfer drum of FIG. 3, which also prints barcode information.
Figure 5:
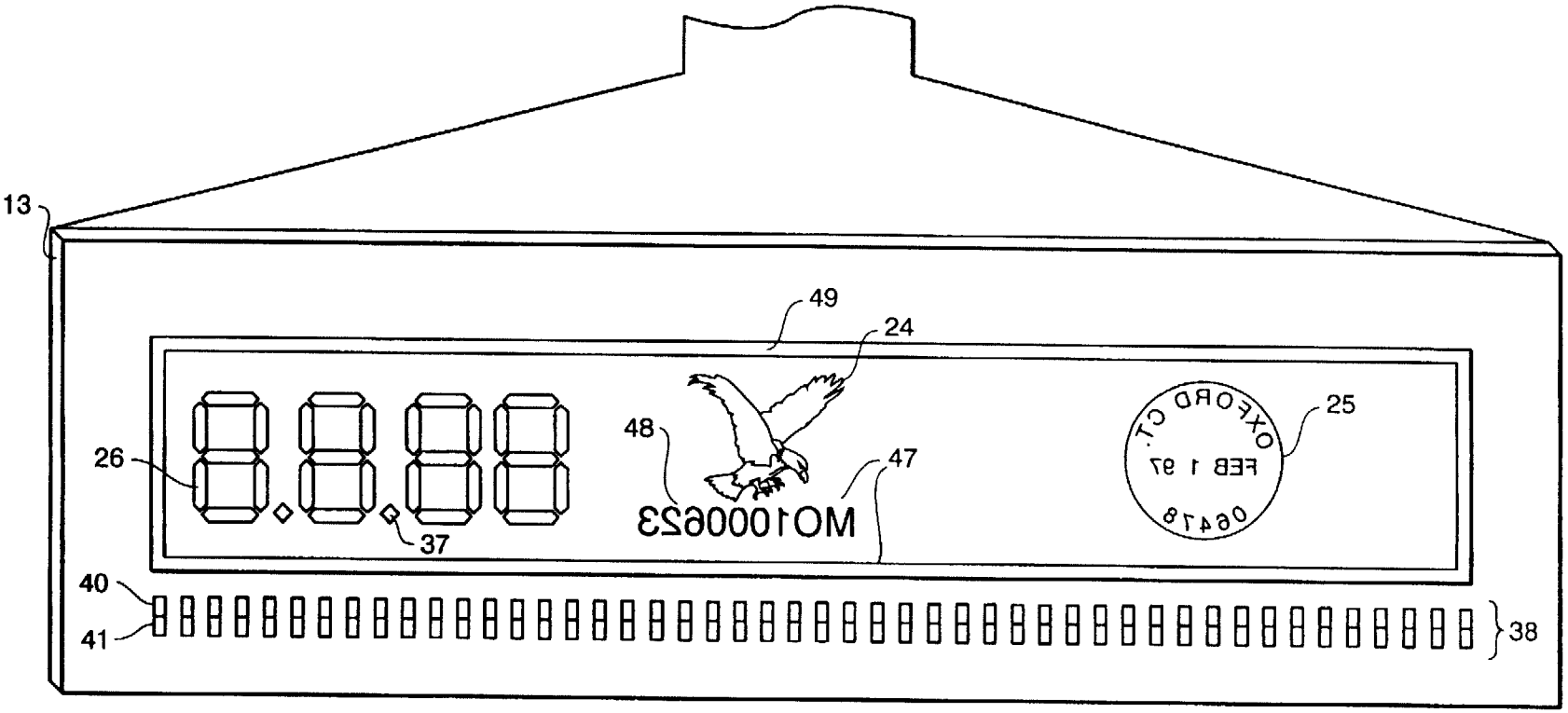
FIG. 5 shows an example of a flat platen transfer means, which prints both numeric and barcode information.

Transfer means 21 can comprise either a transfer drum, such as transfer drums 23 and 17, shown in FIGS. 3 and 4, respectively, or a flat platen, such as platen 13, shown in FIG. 5.

Transfer means 21 includes extendible segments disposed thereon, which are arrangeable to form postage indicia when extended. These segments can be extended by actuators (not shown), such as electromagnetic actuators, pneumatic actuators, or the like, in response to signals from controller 15. These segments can comprise numeric segments for printing numeric information or both numeric segments and barcode segments, the barcode segments for printing barcode information, as described below.

The case where transfer means 21 comprises a transfer drum is shown in FIGS. 3 and 4. More specifically, FIG. 3 shows transfer drum 23, which does not print barcode information. FIG. 4 shows transfer drum 17, which prints barcode information in addition to other postage indicia.

For brevity's sake, only the embodiment of the invention which prints postage indicia comprising both numeric postage information (e.g., postage amount) and barcode information will be described. With respect to the transfer drum shown in FIG. 3, suffice it to say that the present invention can easily be configured not to print the barcode information by simply removing all components used to print the barcode information.

FIG. 5 shows the case where transfer means 21 comprises flat platen 13, which prints both numeric information, e.g. postage amount, and barcode information. As was the case with respect to transfer drum 17, flat platen 13 can be easily configured to print numeric information only. Accordingly, a detailed description of such a configuration is not provided. Moreover, in operation, except as described below, flat platen 13 is identical to transfer drum 17. Accordingly, a detailed description of flat platen 13's operation is also not provided, except as noted.

As shown in FIG. 4, in preferred embodiments of postage meter 1, numeric segments 26 and barcode segments 38 are disposed on plate 28. Plate 28 can be either an integral part of transfer drum 17 or fixed thereto.

Figure 6:
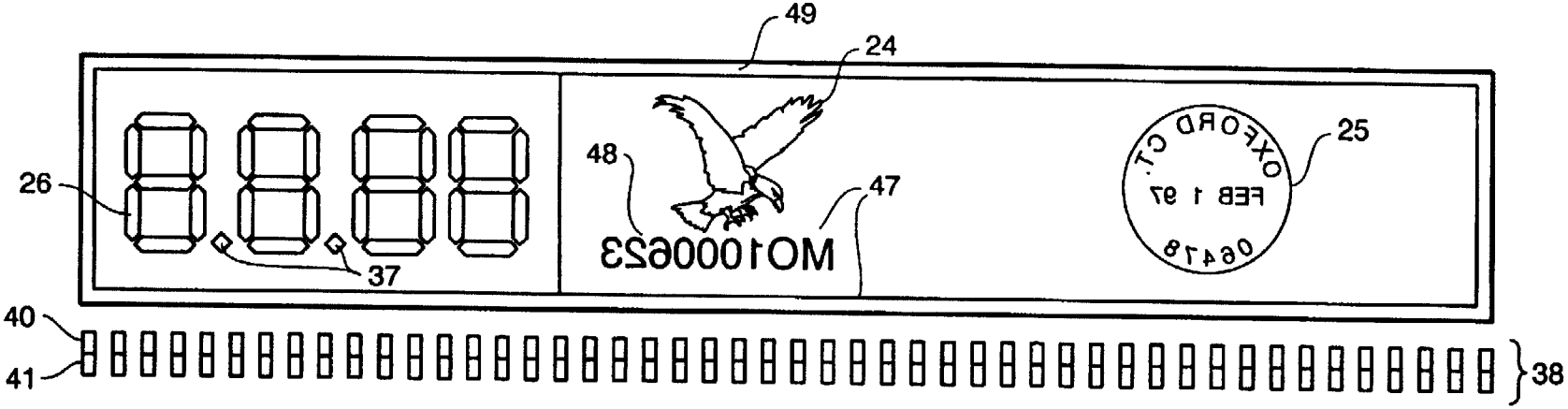
FIG. 6 shows extended segments on a transfer means used in the present invention.
Figure 7:
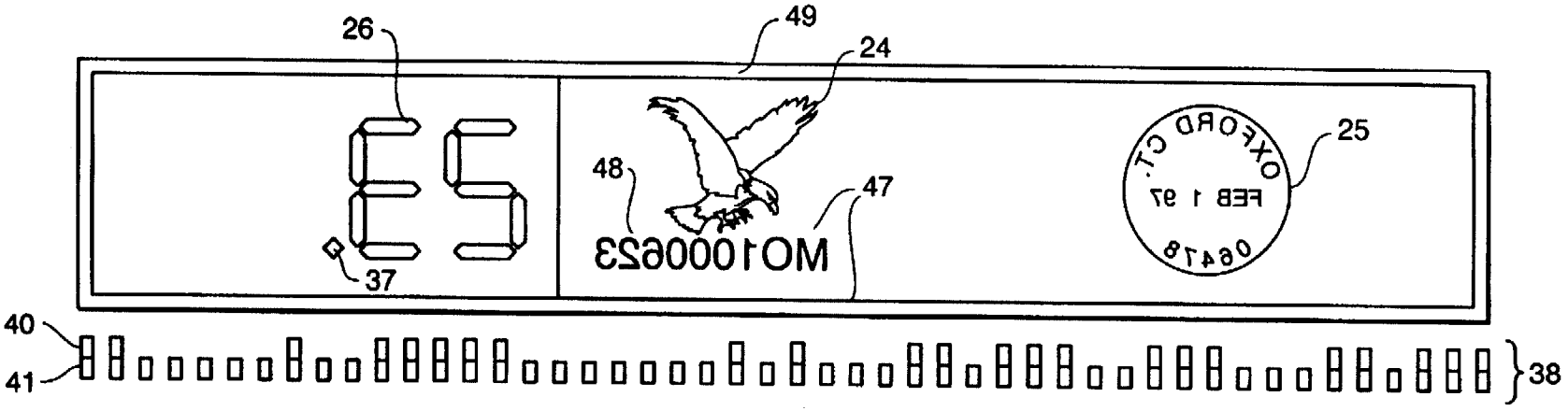
FIG. 7 shows particular ones of the segments shown in FIG. 6 extended to form postage indicia.

As noted above, numeric segments 26 and barcode segments 38 are extended from plate 28 to form postage indicia. FIG. 6 shows a close-up view of numeric segments 26 and barcode segments 38, in which all of the segments are extended. In FIG. 7, on the other hand, only those numeric and barcode segments that correspond to postage indicia 30 shown in FIG. 4 are extended. As shown in FIG. 7, the postage indicia formed on transfer drum 17 by the segments is the mirror image of that to be printed.

Figure 8:
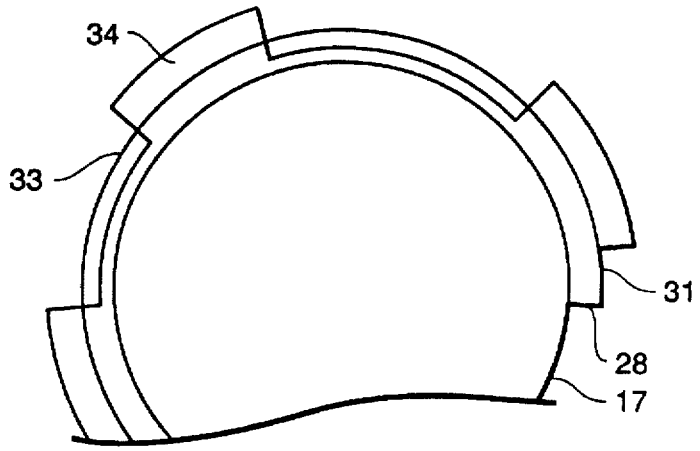
FIG. 8 shows a cross-sectional view of the transfer drum of FIG. 4, having both extended and unextended segments.

In unextended positions, the segments are substantially even with surface 31 of plate 28. Segments 33, shown in the cross-sectional view of transfer drum 17 depicted in FIG. 8, are examples of unextended segments. As described below, this configuration prevents contact between segments 33 and an ink roller, and between segments 33 and an envelope, such as envelope 12 shown in FIG. 1, in postage meter 1.

In extended positions, the segments protrude from transfer drum 17. Segments 34 of FIG. 8 are examples of extended segments. As shown, extended segments 34 protrude from transfer drum 17. This permits segments 34 to contact an ink roller and an envelope in postage meter 1, as will be described in more detail below. Extended segments 34 preferably have a substantially same height, so as to provide even printing of postage indicia on envelopes.

In preferred embodiments of the invention, numeric segments 26 comprise linear segments, as shown in FIGS. 6 and 7. Numeric segments 26 can comprise four sets of seven segments (as shown) arranged so as to permit formation of numeric information, i.e, numbers 0000 to 9999, when extended. It is noted that, although the present invention is described with respect to four sets of seven segments, the present invention is not limited to this configuration. In fact, in other preferred embodiments of the invention, five sets of seven segments are used, in order to represent numbers between 00000 and 99999.

Moreover, the present invention is not limited to forming numbers from numeric segments 26. Rather, the present invention can be configured also to form letters from numeric segments 26.

As shown in FIGS. 6 and 7, the present invention also includes decimal point segments 37, which are retractable segments that extend and retract in response to signals from controller 15 based on input postage information. In preferred embodiments of the invention, decimal point segments 37 are positioned between two of the sets of seven segments, e.g., between two numbers. In particularly preferred embodiments, such as those depicted, postage amounts between $0.000 and $9.999 or between $00.00 and $99.99 can be formed by numeric segments 26 and decimal point segments 37. It is noted, however, that the present invention can be configured to represent other values, as desired.

Barcode segments 38, as noted above, are not present in the embodiment shown in FIG. 3. Barcode segments 38 are used to print barcode information generated by barcode conversion program 22. As noted, in preferred embodiments of the present invention, the barcode information may be used to verify variable postage indicia, such as postage amount, or alternatively, may include barcode equivalents of postage information input by the user. For example, as noted, barcode information can represent barcode-equivalents of numeric information, such as a postage amount.

As shown in FIG. 6, barcode segments 38 comprise top barcode segments 40, each of which represents a top portion of a bar in the barcode information, and bottom barcode segments 41, each of which represents a bottom portion of a bar in the barcode information. In the present invention, bottom barcode segments 41 are permanently extended. Thus, bottom barcode segments 41 can be formed on plate 28 of transfer drum 17 by engraving, for example, or can be affixed thereto. It is noted, however, that bottom barcode segments 41 could be made extendible and retractable in accordance with the technology of the present invention. Top barcode segments 40 operate identically to numeric segments 26 described above. Accordingly, for the sake of brevity, a detailed description thereof is omitted.

As noted above, in preferred embodiments of the present invention, there are 67 bars in the barcode information. Accordingly, in preferred embodiments of the invention, there are 67 barcode segments. Of these 67 barcode segments, the first 31 comprise identifying information for a particular postage meter, such as the postage meter's serial number, etc. Accordingly, these segments do not change. As a result, in preferred embodiments, the first 31 top barcode segments, like bottom barcode segments 41 described above, remain permanently extended. Thus, like bottom barcode segments 41, these first 31 top barcode segments can be engraved on the transfer drum. Likewise, the last barcode segment (i.e., barcode segment number 67), can also be engraved onto the transfer drum, since, as described above, that barcode segment remains permanently extended. In this regard, it is noted that any one or more of the barcode segments can be made permanently extended, as well.

As shown in FIG. 4, transfer drum 17 forms barcode information 44 adjacent to and directly below numeric information 45. This is unlike conventional PostNet barcodes, which are typically formed at the bottom right-hand corner of an envelope. It is noted that although the present invention forms the barcode information below the numeric information, barcode information 44 can be formed on other areas of the envelope, as desired, by repositioning barcode segments 38 on the transfer drum.

Transfer drum 17 also includes fixed postage information 47 (see, e.g., FIG. 6), which can be used to print information such as serial number 48 of postage meter 1, border 49, manufacturer-specific graphics 24, originating zip code, and the like. As was the case with bottom barcode segments 41, permanent extensions 47 typically comprise an engraved die on plate 28.

Also included on transfer drum 17 is a datewheel assembly, which is used to print datestamp 25. The datewheel assembly is controlled by controller 15 to reflect the current date, and, in some embodiments, an originating zip code (06478), and a geographic point of origin (OXFORD, Conn.), as shown.

Figure 9:
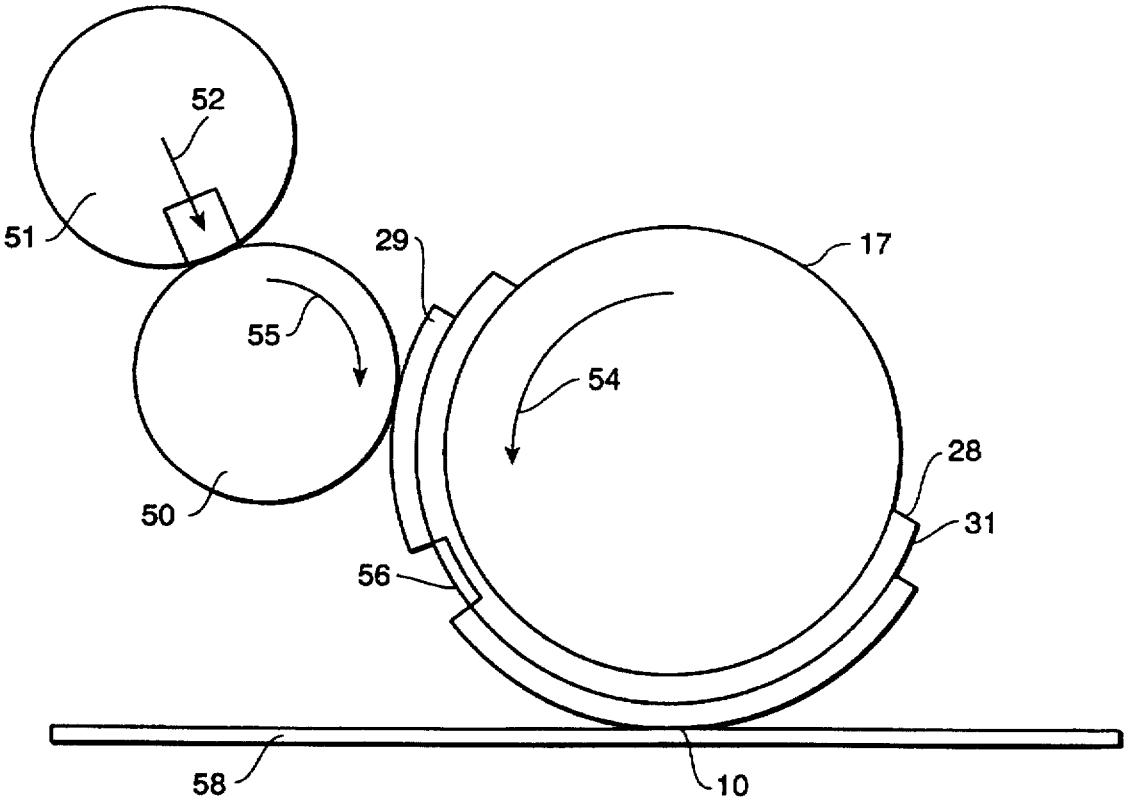
FIG. 9 shows interaction between an envelope, a transfer drum, an ink roller and an ink reserve in the present invention.

As shown in FIG. 9, the present invention also includes ink roller 50 and ink reserve 51. In accordance with the invention, ink is supplied from ink reserve 51 to ink roller 50 in the direction of arrow 52.

In embodiments which include a transfer drum, such as transfer drum 17, transfer drum 17 and ink roller 50 rotate in the direction of arrows 54 and 55, respectively. In operation, extended segments 29 contact ink roller 50, as do the engraved die which forms fixed postage information 47, and the datewheel assembly which forms datestamp 25. Unextended segments 56 do not contact ink roller 50. As a result, ink is transferred from ink roller 50 to extended segments 29, to the engraved die and to the datewheel assembly. Rotation of transfer drum 17 causes extended segments 29, the engraved die and the datewheel assembly to contact envelope 58 at print position 10. Unextended segments 56, however, do not contact envelope 58. Thus, ink is transferred to envelope 58 by extended segments 29, the engraved die and the datewheel assembly, and not by unextended segments 56. In this manner, postage indicia represented by extended segments 29, the engraved die and the datewheel assembly is printed on envelope 58.

In embodiments of postage meter 1 which include flat platen 13, ink roller 55 is rolled along the surface of flat platen 13 which includes extended segments (i.e., numeric segments, barcode segments and decimal-point segments), the engraved die and the datewheel assembly. Thereafter, flat platen 13 is pressed into contact with an envelope to transfer ink from the foregoing features onto the envelope. In this manner, postage indicia, identical to that printed on envelope 58 by transfer drum 17 can be printed by flat platen 13.

In use, controller 15 controls printout of postage indicia onto an envelope by controlling extension of appropriate ones of numeric segments 26, barcode segments 38 and decimal-point segments 37. More specifically, controller 15 interprets postage information input via keypad 3, via rate-calculating scale 5 or via telephone line 7, and based on that information, extends numeric segments 26 and decimal-point segments 37 to form the numeric information portion of the postage indicia. For example, in a case where a postage amount of $0.32 is input into, or is determined by, postage meter 1, controller 15 extends numeric segments 26 and decimal-point segments 37 to form a mirror image of "0.32", as shown in FIG. 7. In addition, in preferred embodiments of the present invention which also print barcode information, controller 15 executes barcode information conversion program 22 to convert the input postage information into barcode information. Thereafter, controller 15 uses this barcode information to extend appropriate ones of top barcode segments 40, as also shown in FIG. 7.

Figure 10:
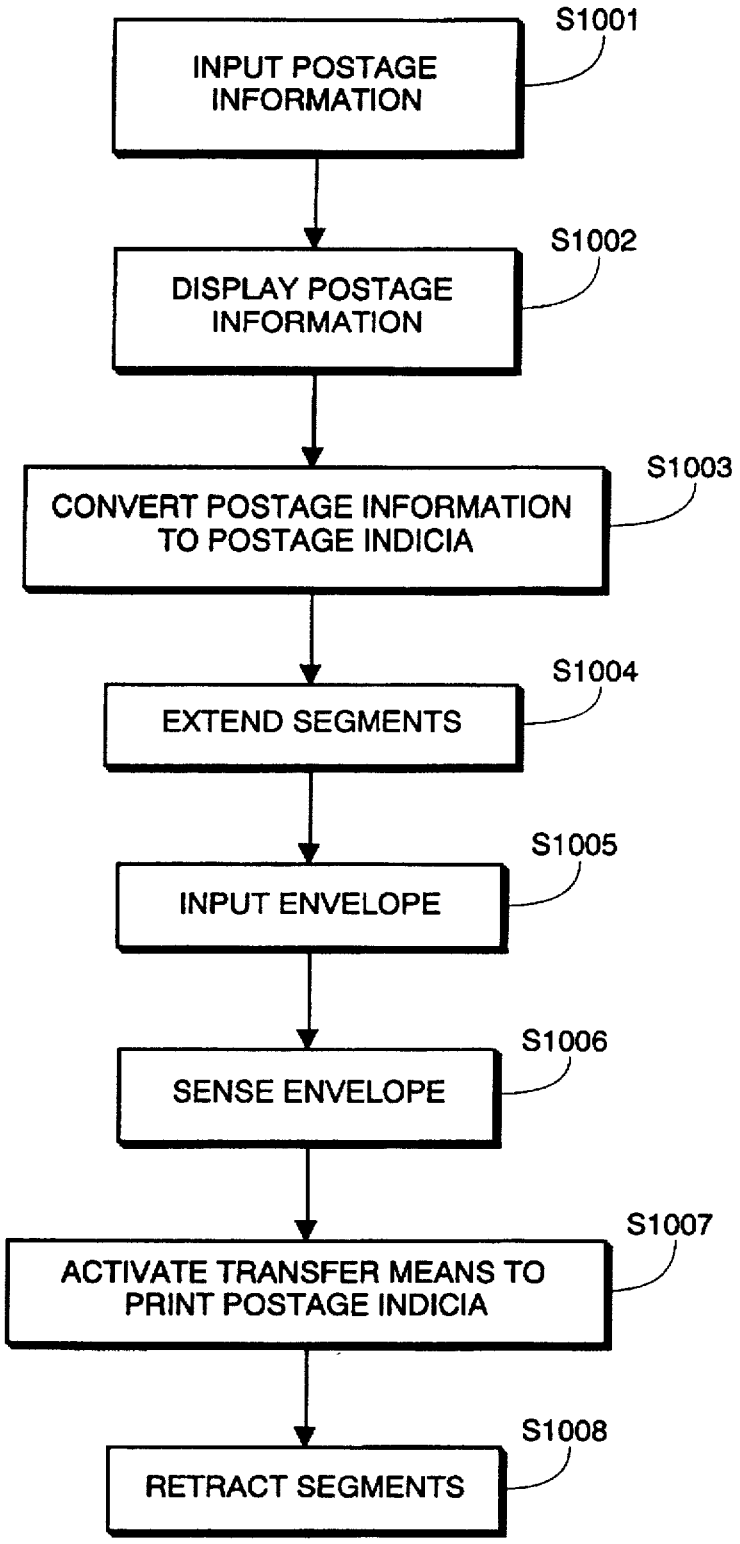
FIG. 10 is a flow diagram showing process steps for printing postage indicia according to the present invention.

A printing operation using postage meter 1, which uses either a transfer drum or a flat platen as a transfer means, will now be described with respect to the flow diagram shown in FIG. 10.

In step S1001, postage information, such as postage amount, is input into (or determined by) postage meter 1. Next, in step S1002, controller 15 converts this postage information into image information, and instructs display 4 to display the image information.

In step S1003, controller 15 converts the postage information into postage indicia, such as numeric information representing a postage amount and/or barcode information. As noted above, barcode conversion is performed by executing barcode conversion program 22 stored in EPROM 20. Segments which represent the postage indicia are then extended in step S1004 by controller 15, as describe in detail above and as shown in FIG. 7.

When an envelope is inserted into envelope guide 9, it is moved to printing position 10 in step S1005. In step S1006, envelope sensor 18 senses the envelope at printing position 10, generates a signal in response to the sensed envelope, and transmits the generated signal to controller 15. In response to this signal, in step S1007, controller 15 activates transfer means 21 so as to print the postage indicia on the envelope. FIGS. 3 and 4 show examples of postage indicia 60 and 30, respectively, which were printed by the present invention onto envelopes 61 and 62, respectively. Following printing of postage indicia, in step S1008, controller 15 retracts all extended segments that are not permanently extended, for security reasons.

The present invention has been described with respect to a particular illustrative embodiment. It is to be understood that the invention is not limited to the above-described embodiments and modifications thereto, and that various changes and modifications may be made by those of ordinary skill in the art without departing from the spirit and scope of the appended claims.

What is claimed is:

1. A postage meter which prints postage indicia comprised of a postage amount, barcode information, fixed postage information, and a datestamp, onto envelopes, the postage meter using a plurality of extendible and retractable segments to print variable portions of the postage indicia including the postage amount and the barcode information, an engraved die to print the fixed postage information, and a datewheel assembly to print the datestamp, the postage meter comprising:

a user interface for entering input information;

a sensor, which senses an envelope in the postage meter, and which outputs a signal which indicates that an envelope is present in the postage meter;

a transfer means having disposed thereon (1) the plurality of extendible and retractable segments, the segments being arranged to form the postage amount and the barcode information when extended, the postage amount comprising individual numerals formed of one or more segments, (2) the engraved die, and (3) the datewheel assembly;

an ink roller, which contacts extended ones of the segments, the engraved die and the datewheel assembly, so as to transfer ink from the ink roller to the extended ones of the segments, the engraved die and the datewheel assembly; and a controller which (1) converts the input information into the postage amount and the barcode information, (2) extends appropriate ones of segments based on the postage amount and the barcode information, and (3) activates the transfer means in response to the signal output by the sensor so that (i) extended segments, the engraved die and the datewheel assembly receive ink by contacting the ink roller, and (ii) the extended segments, the engraved die and the datewheel assembly transfer the ink received from the ink roller to the envelope.

2. A postage meter which prints postage indicia onto envelopes using a plurality of extendible and retractable segments, the postage meter comprising:

a user interface for entering input information;

a transfer means having a plurality of extendible and retractable segments disposed thereon, the segments being arranged to form variable portions of the postage indicia when extended, the variable portions of the postage indicia comprising a numeric postage amount which includes individual numerals comprised of segments;

an ink roller, which contacts extended ones of the segments so as to transfer ink from the ink roller to the extended ones of the segments;

a sensor, which senses an envelope in the postage meter, and which outputs a signal which indicates that an envelope is present in the postage meter; and a controller which (1) converts the input information into the postage indicia, (2) extends ones of the segments, based on the postage indicia, to form the variable portions of the postage indicia, including the numeric postage amount, from extended segments, and (3) activates the transfer means in response to the signal output by the sensor so that (i) the extended segments receive ink by contacting the ink roller, and (ii) the extended segments transfer the ink received from the ink roller to the envelope.

3. A postage meter according to claim 2, wherein (1) in unextended positions, the segments are substantially even with a surface of the transfer means so as to prevent contact with the ink roller and the envelope in the postage meter, and (2) in extended positions, the segments protrude from the transfer means so as to contact the ink roller and the envelope in the postage meter.

4. A postage meter according to claim 2, wherein the user interface comprises a keypad and a display for displaying information input via the keypad.

5. A postage meter according to claim 2, wherein the segments have a substantially same height when extended.

6. A postage meter according to claim 2, wherein, following printing of the postage indicia on the envelope, the extended segments are retracted to their unextended positions.

7. A postage meter according to claim 2, wherein the transfer means comprises a transfer drum; and wherein the transfer drum rotates in response to the signal output by the sensor to contact the envelope in order to print the postage indicia.

8. A postage meter according to claim 2, wherein the transfer means comprises a platen; and wherein the platen presses onto the envelope in response to the signal output by the sensor in order to print the postage indicia onto the envelope.

9. A postage meter according to claim 2, wherein the user interface comprises a rate-calculating scale for weighing the envelope, and for generating a postage amount for the envelope based on a weight of the envelope; and wherein the postage amount generated by the rate-calculating scale comprises the input information.

10. A postage meter according to claim 2, wherein the user interface includes an external interface, over which the input information is transferred to the postage meter; and wherein the postage meter is connected to an external apparatus, which generates the input information and which transfers the input information to the postage meter over the external interface.

11. A postage meter according to claim 10, wherein the external interface comprises a computer interface; and wherein the external apparatus comprises a computer, from which the input information is transferred to the postage meter.

12. A postage meter according to claim 2, wherein the postage indicia further comprises barcode information used to verify the numeric postage amount.

13. A postage meter according to claim 12, wherein the segments on the transfer means comprise barcode segments for forming the barcode information, the barcode segments comprising:

bottom barcode segments, each of which represents a bottom portion of a bar in the barcode information, which are permanently extended, and top barcode segments, each of which represents a top portion of a bar in the barcode information, extension of which are controlled based on the postage indicia.

14. A postage meter according to claim 12, wherein the barcode information is formed on the envelope adjacent to and below the numeric postage amount.

15. A postage meter according to claim 12, wherein the segments on the transfer means comprise linear segments arranged in sets of seven segments, each of the sets of seven segments being arranged so as to permit formation of numbers 0 to 9 by extending appropriate ones of the segments.

16. A postage meter according to claim 15, wherein the segments further comprise point segments, each for forming a decimal point, each of the point segments being positioned between two of the sets of seven segments;

wherein the point segments are extendible and retractable based on the postage indicia.

17. A postage meter according to claim 12, wherein the barcode information comprises 67 bars, the 67 bars being allocated as follows:

bars 1 and 67 comprising long bars;

bars 2 to 5 comprising bars used to identify a type of barcoding used by the postage meter;

bars 6 to 31 comprising bars used to identify a serial number of the postage meter;

bars 32 to 61 comprising bars used to represent an item count comprising a total number of mail pieces printed by the postage meter; and bars 62 to 66 comprising a PostNet check digit.

18. A postage meter according to claim 17, wherein bars 1 to 31 are pre-set to represent predetermined values.

19. A method of forming postage indicia onto an envelope using a postage meter which prints postage indicia comprised of a postage amount, barcode information, fixed postage information, and a datestamp, onto envelopes, the postage meter using a plurality of extendible and retractable segments to print the variable portions of the postage indicia including the postage amount and barcode information, an engraved die to print the fixed postage information, and a datewheel assembly to print the datestamp, the method comprising the steps of:

inputting a postage amount into the postage meter;

converting the postage amount into barcode information;

extending appropriate ones of the plurality of extendible and retractable segments based on the postage amount and the barcode information to form the postage amount and the barcode information, respectively, from extended segments, the postage amount comprising individual numerals formed of one or more segments;

inputting an envelope into said postage meter;

receiving a signal which indicates that the envelope has been input into the postage meter; and activating a transfer means having disposed thereon, (1) the extendible segments, (2) the engraved die, and (3) the datewheel assembly, so that the extended segments, the engraved die and the datewheel assembly receive ink from an ink roller and transfer the ink received from the ink roller onto the envelope input into the postage meter.

20. A method of forming postage indicia on an envelope using a postage meter having a transfer means which forms the postage indicia on the envelope using a plurality of extendible and retractable segments, the method comprising the steps of:

inputting information into the postage meter;

converting the input information into postage indicia;

extending ones of the segments on the transfer means to form variable portions of the postage indicia, the variable portions of the postage indicia comprising a numeric postage amount which includes individual numerals comprised of segments;

inputting an envelope into the postage meter;

receiving a signal which indicates that the envelope has been input into the postage meter; and activating the transfer means so that (1) extended segments contact an ink roller in order to transfer ink from the ink roller onto the extended segments, and (2) the extended segments contact the envelope in order to transfer the ink received from the ink roller to the envelope.

21. A method according to claim 20, further comprising the step of retracting the extended segments following printing of the postage indicia on the envelope.

22. A method according to claim 20, wherein the postage indicia further comprises barcode information used to verify the numeric postage amount.

23. A method according to claim 22, wherein the barcode information comprises 67 bars, the 67 bars being allocated as follows:

bars 1 and 67 comprising long bars;

bars 2 to 5 comprising bars used to identify a type of barcoding used by postage meter;

bars 6 to 31 comprising bars used to identify a serial number of the postage meter;

bars 32 to 61 comprising bars used to represent an item count comprising a total number of mail pieces printed by the postage meter; and bars 62 to 66 comprising a PostNet check digit.

24. A method according to claim 23, wherein the barcode information is used to verify the postage amount by scanning-in the barcode information, and comparing the item count to one of either (1) an item count from a previous day or (2) plural predetermined item counts and a predetermined value;

wherein the postage amount is considered valid if the item count is both greater than the item count from the previous day and different from the plural predetermined item counts and less than the predetermined value; and wherein the postage amount is considered invalid if the item count is either less than the item count from the previous day or the same as one of the plural predetermined item counts or greater than the predetermined value.

* * * * *

UNITED STATES PATENT AND TRADEMARK OFFICE

CERTIFICATE OF CORRECTION

PATENT NO. : 5,699,257

DATED : December 16, 1997

INVENTOR(S) : James S. Emmett, et al.

It is certified that error appears in the above-indentified patent and that said Letters Patent is hereby corrected as shown below:

TITLE PAGE

Under [75] Inventors, "John J. Hobral" should read --John J. Horbal--.

Under [56] References Cited, U.S. Patent Documents, "Pollack, Jr. et al." should read --Pollak, Jr. et al.--.

COLUMN 7

Line 35, "program can" should read --program 22 can--.

COLUMN 11

Line 38, "0.32" should read --.32--.

Signed and Sealed this

Fourteenth Day of July, 1998

Bruce Lehman

*Attest:*

BRUCE LEHMAN

*Attesting Officer*

*Commissioner of Patents and Trademarks*